US007079662B2

(12) United States Patent
Niederdrānk

(10) Patent No.: US 7,079,662 B2
(45) Date of Patent: Jul. 18, 2006

(54) HEARING AID DEVICE WEARABLE IN THE EAR OR HEARING AID DEVICE HAVING AN OTOPLASTIC WEARABLE IN THE EAR

(75) Inventor: Torsten Niederdrānk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 204 days.

(21) Appl. No.: 10/360,125

(22) Filed: Feb. 6, 2003

(65) Prior Publication Data

US 2003/0174846 A1 Sep. 18, 2003

(30) Foreign Application Priority Data

Feb. 6, 2002 (DE) ..... 102 04 894

(51) Int. Cl.
*H04R 25/00* (2006.01)

(52) U.S. Cl. ..... 381/328; 381/322; 381/324

(58) Field of Classification Search ..... 381/322, 381/328, 380, 309, 71.6, 72, 317, 318, 716, 381/83, 93, 95, 324; 181/129, 130, 135
See application file for complete search history.

(56) References Cited

U.S. PATENT DOCUMENTS

| | | | | |
|---|---|---|---|---|
| 4,375,016 | A | 2/1983 | Harada | |
| 5,832,094 | A * | 11/1998 | Le Her | 381/328 |
| 6,339,648 | B1 | 1/2002 | McIntosh et al. | |
| 6,567,524 | B1 * | 5/2003 | Svean et al. | 381/71.1 |

FOREIGN PATENT DOCUMENTS

| | | | |
|---|---|---|---|
| DE | G 90 10 540.0 | | 10/1990 |
| DE | 199 43 809 | | 3/2001 |
| GB | 2197158 | * | 5/1988 |
| WO | WO 01/05207 | | 1/2001 |
| WO | WO 01/69973 | | 9/2001 |

* cited by examiner

*Primary Examiner*—Huyen Le
(74) *Attorney, Agent, or Firm*—Schiff Hardin LLP

(57) ABSTRACT

Acoustic feedbacks can be caused by the aeration channel (5) that is present in hearing aid devices (2) wearable in the ear or hearing aid devices having an otoplastic wearable in the ear. In order to avoid this, it is provided that the aeration channel be subdivided into at least a first and a second sub-region, whereby the sub-region (5A) that is proximal when the hearing aid device (2) is worn or when the otoplastic is worn comprises a small cross-sectional area and a great length compared to the distal, second sub-region (5B).

8 Claims, 1 Drawing Sheet

HEARING AID DEVICE WEARABLE IN THE EAR OR HEARING AID DEVICE HAVING AN OTOPLASTIC WEARABLE IN THE EAR

BACKGROUND OF THE INVENTION

1. Field of the Invention

The invention is directed to a hearing aid device wearable in the ear or hearing aid device having an otoplastic wearable in the ear, comprising an aeration channel.

2. Description of the Related Art

The aeration channel ("ventilation bore" or "vent") of a hearing aid device wearable in the ear or of a hearing aid device having an otoplastic wearable in the ear serves for ventilating the ear canal, for atmospheric pressure compensation, or for reducing the closure effect (occlusion effect). It is desirable to provide an aeration channel having an optimally large cross-section.

However, the aeration channel represents an acoustic bypass to the signal path via the input transducer, the signal processing unit, and the output transducer of the hearing aid device, which can reduce functions of the hearing aid device such as a particular directional effect or an unwanted noise reduction, making these functions ineffective, particularly in a loud acoustic situation. Furthermore, feedback between the output transducer and the input transducer can occur via the aeration channel, particularly in acoustic situations with a low input signal level and a high gain of the hearing aid device caused by dynamic compression. This effect, too, is dependent on the cross-section of the aeration channel. These issues are addressed by optimizing for a smaller cross-section of the aeration channel results. The width of the aeration channel thus represents a compromise between wearing comfort and performance features of the hearing aid device. The aeration channel is usually adapted in the hearing aid device by inserting sleeves with different bores for constricting the aeration channel.

U.S. Pat. No. 6,339,648 B1 discloses a part introducible into an auditory canal. This part can be fashioned as otoplastic in combination with a hearing aid worn behind the ear as a hearing protection device or as a hearing aid worn in the ear. The part can be filled through a first channel so that the exterior shape of the part adapts individually to the respective auditory canal. Furthermore, an aeration channel having a constant cross-sectional area over its entire course is present. Over and above this, an acoustic channel is present that is widened at one end and can thus accept a plug in the embodiment of the part as hearing protection device and a sound hose given the embodiment of the part as otoplastic.

SUMMARY OF THE INVENTION

An object of the present invention is to provide an aeration channel in a hearing aid device wearable in the ear or a hearing aid device having an otoplastic wearable in the ear such that a good ventilation effect is achieved and the risk of feedback through the aeration channel is minimized at the same time.

For a hearing aid device wearable in the ear or hearing aid device having an otoplastic wearable in the ear, comprising an aeration channel, this object is achieved in that the aeration channel is subdivided into at least a first and a section sub-region, where the first sub-region that is proximal when the hearing aid device is worn or the otoplastic is worn comprises a first cross-sectional area and a first length, and the distal, second sub-region comprises a shorter length and a larger cross-sectional area compared to the first sub-region.

In an exemplary embodiment, the aeration channel can be represented in a first approximation by the transmission of the acoustic pressure via a mass. The outlet of the aeration channel, the "ventilation opening", emits a sound signal into free space, which can in turn be described via a moved medium mass. This mass-affected division of the adjacent acoustic pressure is approximately frequency-independent and sees to a strong emission from the ventilation opening.

Proceeding from this exemplary embodiment, the decisive, moved medium mass of the ventilation opening can be reduced via a targeted variation of the ventilation channel. A diminished radiation impedance takes effect due to a modified cross-section at the end of the aeration channel given an aeration channel that is otherwise unmodified. The advantage compared to the traditional ventilation systems is that the diminishing acoustic emission goes into space. This yields a clearly improved stability of the hearing aids in practice and, second, allows the employment of an aeration channel having an enlarged cross-sectional area in all sub-regions compared to a traditional hearing aid device or to a traditional otoplastic upon retention of the stability conditions.

Advantageously, the proximal sub-region of the aeration channel of the invention, when the hearing aid device is worn or the otoplastic is worn, is significantly longer than the distal sub-region having the enlarged cross-sectional area. This permits the flow resistance of the aeration channel to remain essentially unaltered. It has been shown in practice that the length of the first sub-region should comprise at least five times the length of the second sub-region.

It was found with respect to the size relationships of the cross-sectional areas that one can achieve a significant reduction of the emission of the sound parts emitted from the ventilation opening when the cross-sectional area of the second sub-region advantageously comprises at least three times the cross-sectional area of the first sub-region.

One embodiment of the invention provides that, particularly given loner aeration channels, acoustic filter elements are arranged in an aeration channel. Longer aeration channels cause the occurrence of line resonances at which the acoustic conductivity of the aeration channel is maximized. The occurrence of resonance effects is prevented by the acoustic filter elements. The filter elements can, for example, be fashioned as discontinuities in cross-section or as acoustic damping elements introduced into the aeration channel.

DESCRIPTION OF THE DRAWINGS

The invention is described in greater detail below on the basis of an exemplary embodiment.

DETAILED DESCRIPTION OF THE INVENTION

Figure 1:
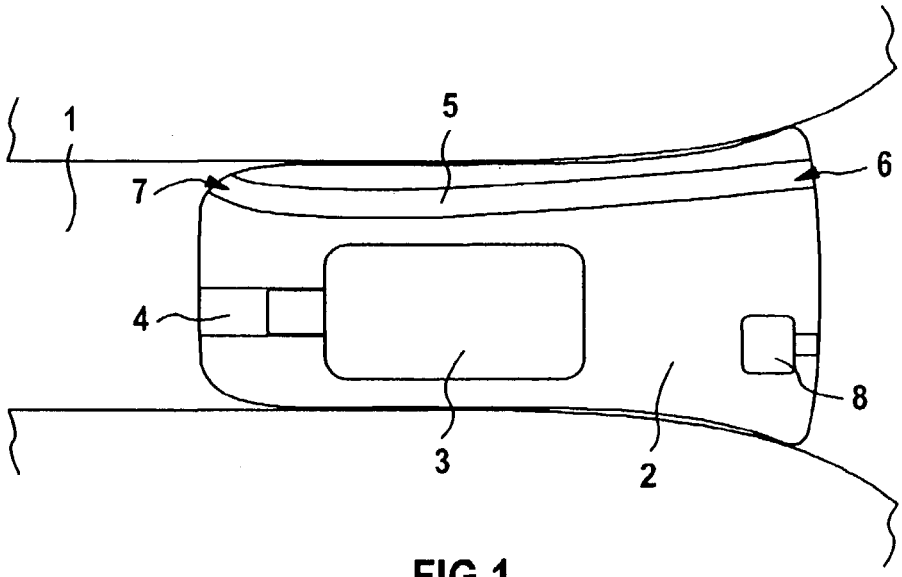
FIG 1 PRIOR ART
FIG. 1 is a pictorial diagram showing a hearing aid device wearable in the ear that has an aeration channel according to the Prior Art.

In a schematic, highly simplified presentation, FIG. 1 shows a hearing aid device 2 arranged in the auditory canal 1 of a hearing aid user. An acoustic signal is supplied to the ear of the hearing aid user via, on the one hand, a microphone 8, a signal processing unit (not shown) and an earphone with allocated earphone channel 4 and, on the other hand, via the aeration channel 5. The aeration channel 5 thus represents a bypass for the electro-acoustic signal path through the hearing aid device 2.

In specific acoustic situations, for example, given slight acoustic amplification of the hearing aid device due to a loud sound environment, this bypass is dominant over the signal path through the hearing aid device. This can limit the effectiveness of specific functions or aspects of the hearing aid device such as, for example, a desired directional effect or a reduction of unwanted noise. Over and above this, feedbacks between the earphone 3 and the microphone 8 can also occur due to communication via the aeration channel 5. The acoustic input signals that are picked up by the microphone 8 and converted into electrical signals are conducted through the signal processing unit and subsequently supplied to an earphone 3. This in turn emits acoustic signals into the ear canal 1 via the earphone channel 4. Via the proximal ventilation opening 7 and the aeration channel 5, these acoustic signals partially proceed back into the exterior space and reach the microphone 8 after being emitted from the distal ventilation opening 6. The feedback path has thus been closed. The aeration channel 5 should therefore comprise only a relatively small cross-sectional area. This, however, deteriorates the ventilation of the part of the ear canal 1 closed off by the hearing aid device 2.

Figure 2:
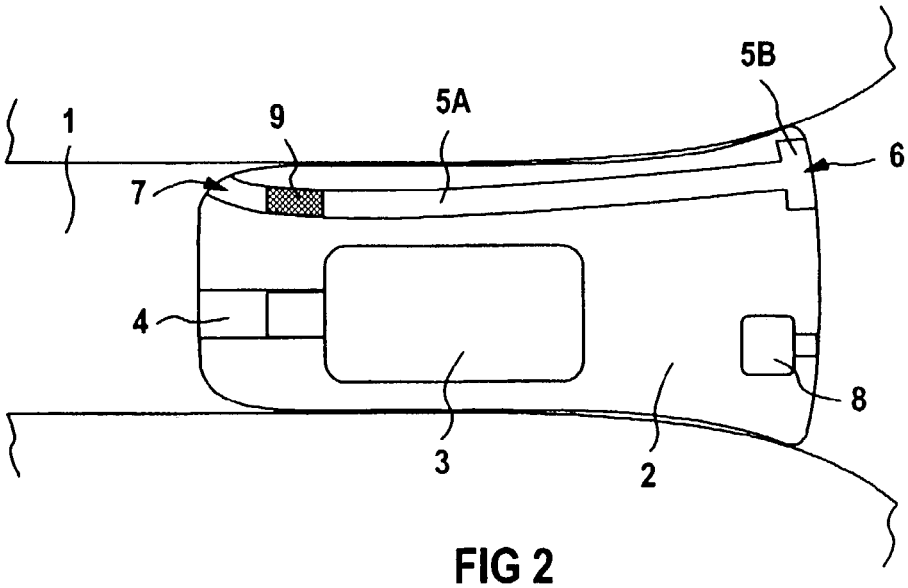
FIG. 2 is a pictorial diagram showing a hearing aid device wearable in the ear that has an aeration channel according to the invention.

FIG. 2 likewise shows a hearing aid device 2 that is situated in the ear canal 1 of a hearing aid user. However, the aeration channel has been inventively modified in that a second sub-region 5B of the aeration channel facing away from the head is widened compared to a first sub-region 5A facing toward the head, resulting in an enlarged cross-sectional area of the second sub-region 5B compared to the first sub-region 5A. The length relationships of the sub-regions are preferably dimensioned such that the sub-region 5A is significantly longer than the sub-region 5B. This assures that the flow resistance of the aeration channel essentially corresponds to the flow resistance of the sub-region 5A.

This modification of the aeration channel in the region of the distal ventilation opening reduces the decisive, moved medium mass of this ventilation opening 6. The modified cross-section at that end of the aeration channel facing away from the head given what is otherwise an unmodified channel achieves a reduced radiation impedance. This results in a reduction in the acoustic pressure of the signal that is output via the earphone 3 and that returns to the microphone via the earphone channel 4 and the aeration channel 5A, 5B compared to the acoustic pressure of a comparable signal given a hearing aid device having a traditional aeration channel. This reduces the feedback tendency of the hearing aid device. Overall, the bandwidth of the acoustic signals that can be transmitted by the hearing aid device 2 of the invention can be expanded in the direction of higher frequencies. Furthermore, the overall cross-section of the aeration channel can be expanded compared to the cross-section of an aeration channel in a traditional hearing aid device without having a resultant feedback tendency of the hearing aid device.

An acoustic damper 9 is present in the aeration channel in the hearing aid device 2 according to FIG. 2 as a further possibility for diminishing the part of the acoustic energy that is emitted via the aeration channel into the outside environment and that can be picked up again by the microphone. This prevents the occurrence of resonance effects in the aeration channel.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional structures and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

1 ear canal
2 hearing aid device wearable in the ear
3 earphone
4 earphone channel
5 aeration channel
5A,5B sub-regions of the aeration channel
6 distal ventilation opening
7 proximal ventilation opening
8 microphone
9 filter element

What is claimed is:

1. A hearing aid device wearable in the ear or hearing aid device having an otoplastic wearable in the ear, comprising:

a microphone configured to acquire an acoustic input signal at an acoustic input and convert it into an electrical signal;

an earphone configured to convert a processed electrical signal into an acoustic output signal;

an aeration channel comprising:

a proximal opening on an end closer to an eardrum that receives a part of the earphone acoustic output signal; and a distal opening that transmits the part of the earphone acoustic output signal to the acoustic input;

the aeration channel being subdivided into at least a first proximal sub-region comprising the proximal opening and a second distal sub-region comprising the distal opening, the first proximal sub-region that is proximal when the hearing aid device is worn or the otoplastic is worn comprising a first cross-sectional area and a first length, and the second distal sub-region comprises a shorter length and a larger cross-sectional area compared to the first sub-region.

2. The hearing aid device according to claim 1, wherein the first sub-region comprises at least five times the length of the second sub-region.

3. The hearing aid device according to claim 1, characterized in that the second sub-region comprises at least three times the cross-sectional area of the first sub-region.

4. The hearing aid device according to claim 1, further comprises:

the first sub-region being configured to discharge into the proximal opening and the second sub-region discharges into the distal opening.

5. The hearing aid device according to claim 1, further comprising:

an acoustic filter element arranged in the aeration channel.

6. The hearing aid device according to claim 1, wherein the larger cross-sectional area of the second distal sub-region of the aeration channel is unobstructed.

7. The hearing aid device according to claim 1, wherein the second distal sub-region of the aeration channel comprises the distal opening of the aeration channel and the distal opening has the larger cross-sectional area.

8. The hearing aid device according to claim 1, wherein the acoustic input and the distal opening of the aeration channel are both located on a distal end of the hearing aid device and are physically separated by some distance from one another.

* * * * *